United States Patent [19]

Nassof

[11] Patent Number: 4,549,375

[45] Date of Patent: Oct. 29, 1985

[54] CEILING CONSTRUCTION

[75] Inventor: Martin Nassof, Cliffside Park, N.J.

[73] Assignee: Simplex Ceiling Corporation, Hoboken, N.J.

[21] Appl. No.: 501,845

[22] Filed: Jun. 7, 1983

[51] Int. Cl.[4] ..... E04B 5/52; G09F 7/18

[52] U.S. Cl. ..... 52/39; 52/484; 52/762; 52/727; 52/DIG. 8

[58] Field of Search ..... 52/39, 506, 508, 484, 52/762, 727, DIG. 8

[56] References Cited

U.S. PATENT DOCUMENTS

| | | | |
|---|---|---|---|
| 1,997,581 | 4/1935 | Heeren et al. | 52/484 |
| 1,997,605 | 4/1935 | Strom et al. | 52/508 |
| 2,059,483 | 11/1936 | Parsons | 52/484 |
| 2,238,514 | 4/1941 | Weeks et al. | 52/484 |
| 2,412,404 | 12/1946 | Jackson | 52/762 |
| 2,478,060 | 8/1949 | Spiess | 52/762 |
| 2,734,126 | 2/1956 | Kruger | 52/484 |
| 2,852,663 | 9/1958 | Stuffer et al. | 52/507 |
| 3,004,644 | 10/1961 | Hull | 52/484 |
| 3,017,973 | 1/1962 | Schwartz | 52/507 |
| 3,277,624 | 10/1966 | Cornell | 52/484 |
| 3,300,940 | 1/1967 | Colasz | 52/718 |
| 3,426,489 | 2/1969 | Lambert | 52/508 |
| 3,461,630 | 8/1969 | Lovullo | 52/762 |
| 3,530,625 | 9/1970 | Ollinger | 52/762 |
| 3,596,425 | 8/1971 | Kodaras | 52/484 |
| 3,599,921 | 8/1971 | Cumber | 52/484 |
| 3,958,388 | 5/1976 | Hawes | 52/785 |
| 3,998,020 | 12/1976 | Kuhr et al. | 52/484 |
| 3,998,419 | 12/1976 | Semmerling | 52/484 |
| 4,009,549 | 3/1977 | Hala | 52/506 |
| 4,084,364 | 4/1978 | Jones | 52/484 |
| 4,294,054 | 10/1981 | Kuhr | 52/484 |

*Primary Examiner*—Donald G. Kelly
*Assistant Examiner*—Michael Safavi

[57] ABSTRACT

A unit for use with a snap-in metal ceiling panel, which comprises an elongated snap-bar comprising spring-like arms extending from a common, integrally formed base portion and terminating in opposed free ends biased towards one another, first and second elongated members held within said spring-like arms and depending from said snap-bar, said first member having a first portion held within said snap-bar and a second portion transverse to said first portion and terminating in a free end, and said second member having a body portion with one edge thereof held within said snap-bar and with a clip portion longitudinally extending along the opposite edge thereof, said clip portion having a spring-like arm integral with said body portion terminating in a free end biased toward said body portion, said clip portion facing away from said transverse portion and being operable to retain a side wall of a metal ceiling panel. This unit is adapted to form the nucleus of a multi-purpose pocket or a soffit for a ceiling beam depending from a floor slab.

5 Claims, 5 Drawing Figures

FIG. 1
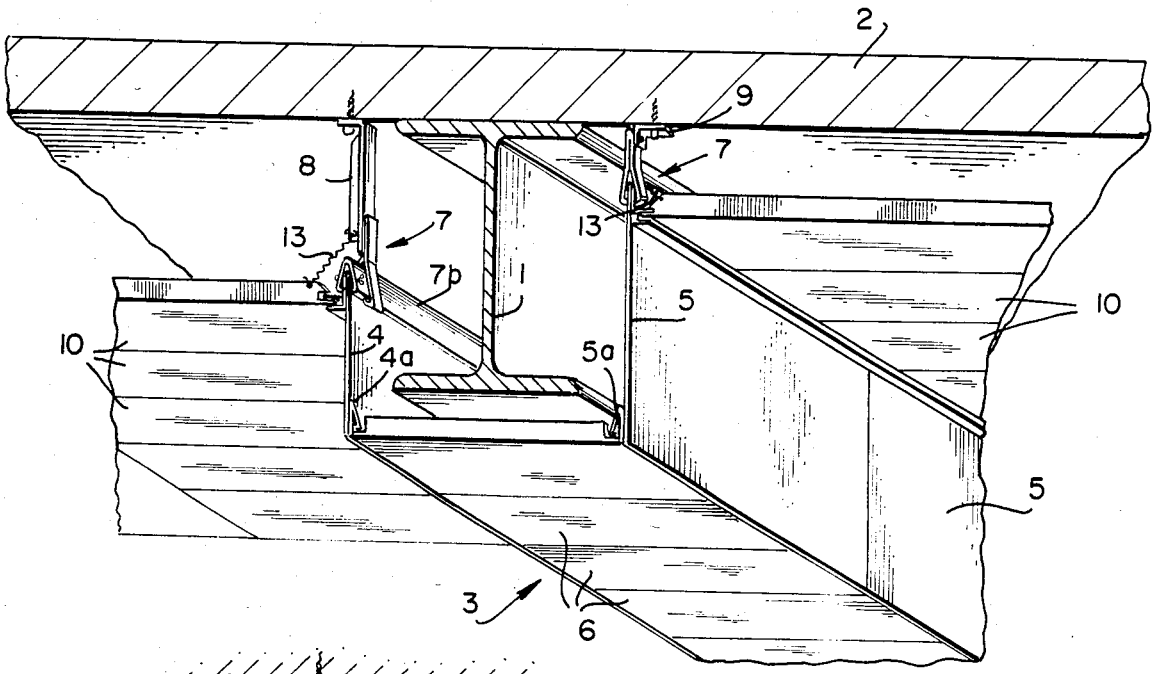
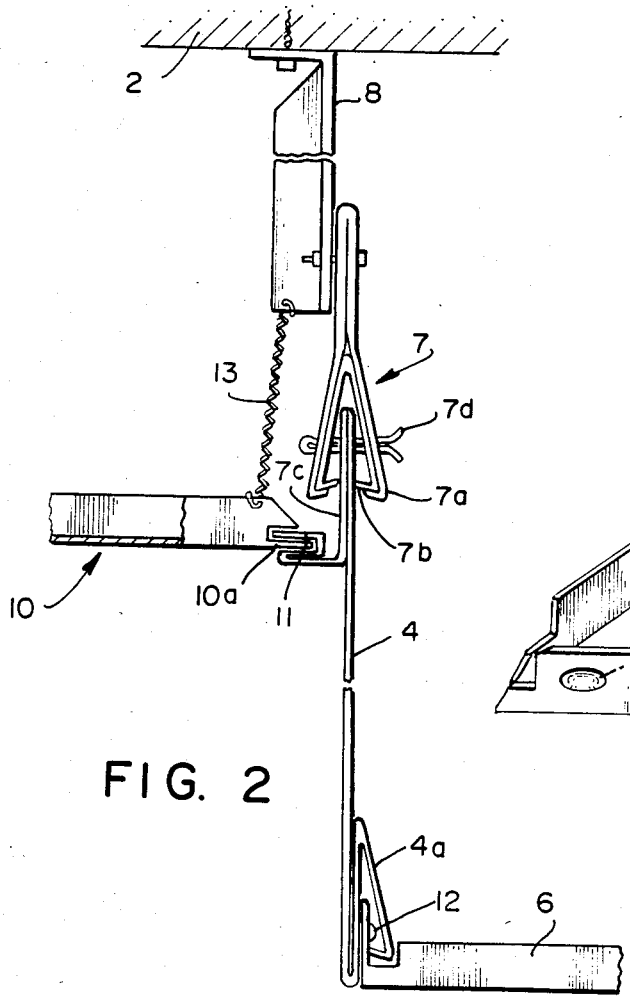
FIG. 2
FIG. 3
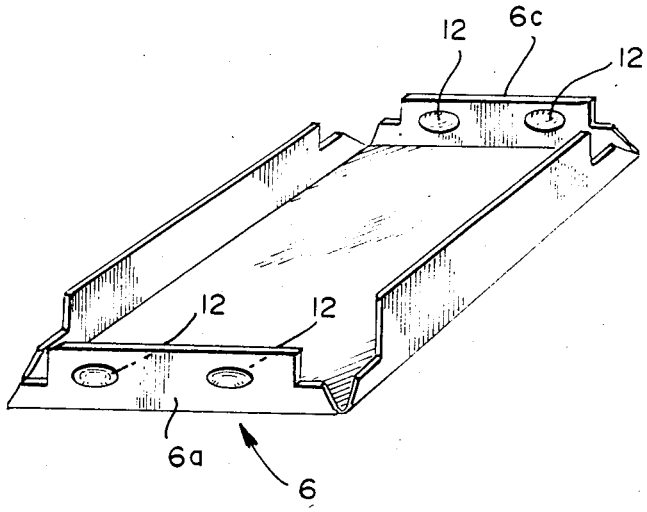

CEILING CONSTRUCTION

The present invention relates to a soffit for a suspended ceiling.

In the assembly of a suspended ceiling using snap-in ceiling panels, it is sometimes desirable to enclose a ceiling beam rather than simply suspending the entire ceiling at a distance below the beam. In such cases, a soffit must be used to enclose the beam.

Various soffit systems are known, such as the simple box-like constructions of U.S. Pat. Nos. 2,238,541, 3,300,940 and 3,277,624, and the more sophisticated construction of U.S. Pat. No. 4,294,054. The former are totally unsuitable for modern suspended ceilings, whereas the latter is unsuitable for suspended ceilings based on metal panels.

The present invention now provides a soffit for a suspended ceiling based on metal panels, in which prefabricated snap-bars and snap-bar hangers are used to suspend prefabricated riser plates and slip molds. From these standardized parts, a soffit can be easily and rapidly assembled during the construction of the ceiling itself.

The present invention also provides, by the use of the same essential parts, a multi-purpose pocket, which can be used, for example, for concealing drapery track hardware.

In its broadest terms, the present invention thus provides a unit from which the soffit or the multi-purpose pocket can be assembled, which comprises:

a. an elongated snap-bar comprising spring-like arms extending from a common, integrally formed base portion and terminating in opposed free ends biased towards one another;

b. first and second elongated members held within said spring-like arms and depending from said snap-bar;

c. said first member having a first portion held within said snap-bar and a second portion transverse to said first portion and terminating in a free end; and d. said second member having a body portion with one edge thereof held within said snap-bar and with a clip portion longitudinally extending along the opposite edge thereof, said clip portion having a spring-like arm integral with said body portion terminating in a free end biased toward said body portion, said clip portion facing away from said transverse portion and being operable to retain a side wall of a metal ceiling panel.

The present invention is illustrated in terms of preferred embodiments in the accompanying drawings, in which:

FIG. 1 is a view, in perspective, of the soffit according to the invention;

FIG. 2 is an enlarged, side elevational detail view of the soffit of FIG. 1;

FIG. 3 is a perspective view of a metal ceiling pan used in the invention;

Figure 4:
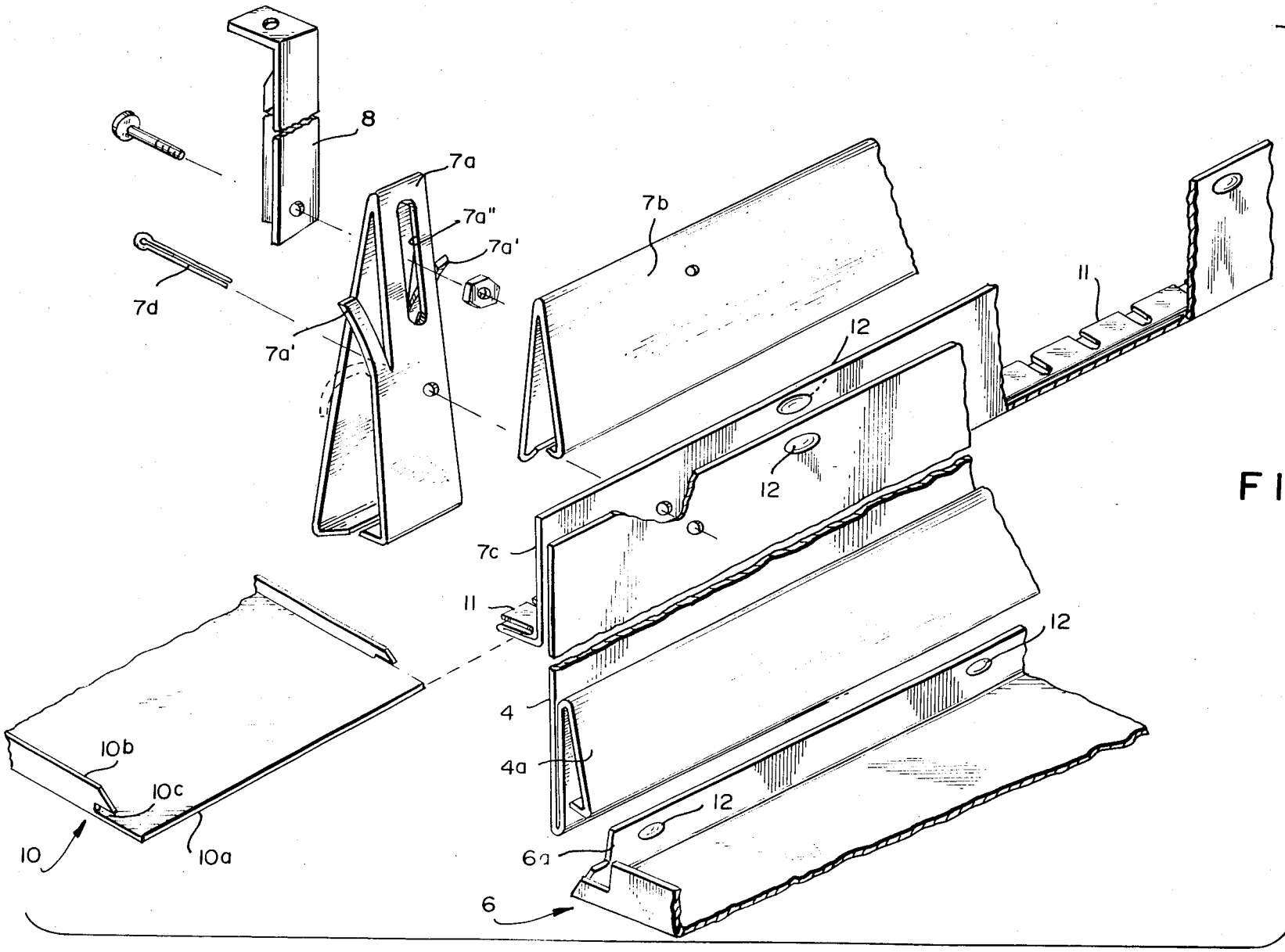
FIG. 4 is an exploded view, in perspective, of the parts illustrated in FIG. 2.

Referring to FIG. 1, a beam 1 depends from a floor slab 2 in a conventional manner. When hanging a suspended ceiling below floor slab 2, it is desired to conceal the beam 1, and this is accomplished by soffit 3 comprising vertical, metal riser plates 4 and 5, a plurality of horizontally disposed metal ceiling panels 6 secured to the lower ends of the riser plates 4, 5, and a pair of metal hangers 7 at the upper ends of the riser plates 4,5. The hanger 7 that is attached to riser plate 4 is secured to floor slab 1 by means of bracket 8, whereas the other hanger 7 is secured to the floor slab 2 by bracket 9. Metal ceiling panels 10 extend away from either side of soffit 3, and are suspended from slab 2 in a conventional manner (not shown) to complete the suspended ceiling. Ceiling panels 6 and 10 are suitably 12 inches wide and up to 60 inches long.

FIG. 2 presents a detail view of the riser plate 4, hanger 7 and bracket 8. As can be seen therein, hanger 7 includes a snap bar hanger 7*a* fastened by suitable fastening means to bracket 8. A plurality of brackets 8 and their associated hangers 7*a* will be spaced along the length of beam 1 at suitable intervals, but usually not more than five feet apart. Running through and suspended from the hangers 7*a* are metal snap bars 7*b*, which are butted end-to-end to form a continuous snap bar unit extending the length of the soffit 3. Snap bars 7*b* are suitably from 8 to 10 feet long. Snap bars 7*b* are of conventional construction and have a pair of opposed spring-like arms extending from a common, integrally formed base portion and which terminate in opposed free ends biased towards one another, as shown.

The upper end of riser plate 4 and of metal slip mold 17*c* are fitted within the snap bar 7*b* and are held in place by a suitable fastener, such as cotter pin 7*d*. Ceiling panel 10 is joined to the soffit 3 by slip mold 7*c* in a manner as will be described in detail below. The lower end of riser plate 4 terminates in a spring clip 4*a*, into which is fitted one end 6*a* of the ceiling panel 6. Spring clip 4*a* will open to permit entry of the dimple 12 when the end 6*a* is forced into the clip 4*a*, and it will retain the end 6*a* in place. Riser plate 5 is constructed in the same manner as riser plate 4, except that it has a shorter height. Thus, the end 6*c* of panel 6 (FIG. 3) will be retained within the spring clip 5*a* by means of dimples 12 on the inner wall of end 6*c*. Both spring clips 4*a* and 5*a* have a spring-like arm having a free end biased inwardly towards the riser plates 4,5, respectively.

Turning now to FIG. 4, it can be seen that panels 10 have an open end 10*a*, which is push-fitted between and is retained by the fingers 11 of slip mold 7*c*. The longitudinally extending edges 10*b* of panel 10 are preferably slotted as at 10*c*, so that the end 10*a* may be pushed all the way under fingers 11. The end (not shown) of panel 10 remote from end 10*a* is secured to a conventional ceiling panel hanger (not shown) suspended from slab 2.

Snap bar hanger 7*a* (FIG. 4) preferably has a slot 7*a*'' to facilitate leveling of the panel 6 by vertically moving hanger 7*a* up or down, as desired. Hanger 7*a* is likewise preferably provided with ears 7*a*' that can be bent over the snap bar 7*b* to ensure proper retention of the snap bar 7*b* within hanger 7*a*.

It will be appreciated that the only essential difference between brackets 8 and 9 and riser plates 4 and 5, respectively, is their vertical heights. Otherwise, the rest of the soffit 3 of the invention are prefabricated parts, namely, 7*a*, 7*b*, 7*c*, 7*d* and 6. It can thus be seen that the soffit 3 is provided from standardized parts, which may be rapidly assembled in the field.

The soffit 3 according to the invention is assembled as follows. First, the beam 1 is framed in by securing brackets 8, 9 on either side of the beam. If the ceiling panels 10 are to be at the same height on either side of the soffit 3, then brackets 8, 9 and riser plates 4, 5 respectively, will be of the same size. Otherwise, brackets 8, 9 and plates 4, 5 respectively will be of different sizes, as shown.

Snap bars 7*b* are then slid into the hangers 7*a*, ears 7*a'* are bent over the snap bar 7*b*, and the upper portions of riser plate 4 and of slip mold 7*c* are inserted into the snap bar 7*b* and are fastened together by the pin 7*d*. The upper portions of riser plate 4 and of slip mold 7*c* are provided with dimples 12, which act to secure these elements within snap bar 7*b* in the same manner as the dimples 12 secure panel 6 within clip 4*a*. Panels 10 are then field cut to expose the end 10*a* and to form the slot 10*c*, after which the end 10*a* of each panel 10 is inserted into fingers 11. Wire 13 is connected between flange 10*b* and bracket 8 as a precaution against accidental displacement of the various parts during assembly. The procedure is then repeated on the other side of the soffit followed by fitting panel 6 into clips 4*a* and 5*a*.

Figure 5:
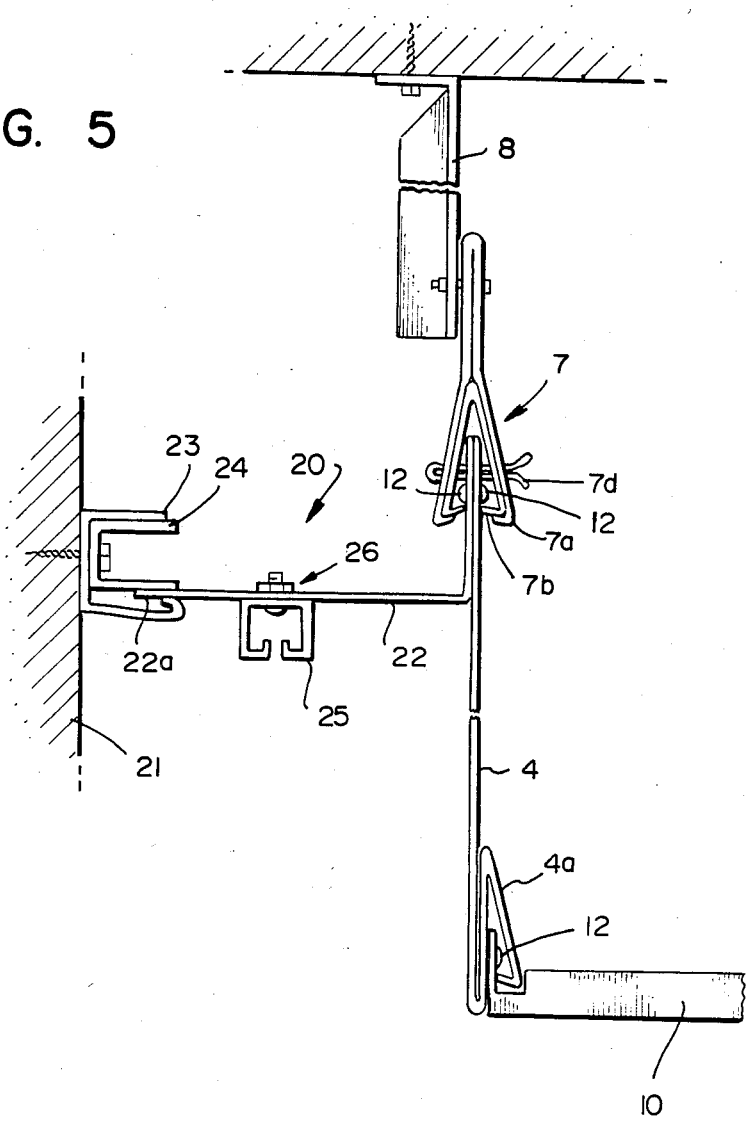
FIG. 5 is a view similar to that of FIG. 2 illustrating the multi-purpose pocket of the invention.

Referring to FIG. 5, the multi-purpose pocket 20 of the invention is secured between a wall 21 and the first ceiling panel 10 adjacent the wall 21. To form the pocket 20, bracket 8 is spaced a suitable distance from the wall 21, usually up to 8 inches, and the hanger 7 is secured to bracket 8 so that a riser plate 4 of desired height can be snapped into snap bar 7*b*. Instead of the slip mold 7*c*, however, a pocket mold 22 is snapped into the snap bar 7*b*, with pocket mold 22 being provided with dimples 12 to retain the mold 22 in place. The free end 22*a* of mold 22 is secured within channel members 23 and 24, which are in turn secured to wall 21 by a suitable fastener. Drapery track 25 is shown secured to pocket mold 22 by means of a suitable fastener and retaining washer 26, so that the pocket 20 is thus used to provide a built-in drapery track. If a pocket 20 is to be formed on the wall (not shown) opposite wall 21, the construction would be identical, except that riser plate 5 would be used instead of riser plate 4.

Other hardware can be installed in pocket 20, if desired, such as lighting, audio speakers and the like; the drapery track 25 is shown merely for illustration.

It can be seen from FIG. 5, that pocket 20 employs the same hanger 7, bracket 8, riser plates 4 or 5 and pans 10 as described above for the soffit 3. Pocket 20 merely has an L-shaped mold member 22 in place of the L-shaped slip mold 7*c*.

I claim:

1. A unit for use in a metal ceiling panel suspended ceiling, which comprises:

a. an elongated snap bar comprising spring-like arms extending from a common, integrally formed base portion and terminating in opposed free ends biased towards one another;

b. vertically disposed first and second members held within said spring-like arms and depending from said snap bar;

c. said first member having a vertically disposed portion held within said snap-bar and a horizontally disposed portion terminating in a free end;

d. said second member having a planar body portion with one horizontal edge thereof held within said snap-bar and with a clip portion longitudinally extending along and positioned above the opposite horizontal edge of said body portion, said clip portion having a spring-like arm integral with said body portion terminating in a free end biased toward said body portion, said clip portion facing away from said horizontally disposed portion;

e. a metal ceiling panel having a horizontally disposed planar bottom portion and a pair of opposed vertically disposed side walls, one of which being snap-fitted into said clip portion, whereby said planar bottom portion of said panel is perpendicular to said body portion; and f. the vertical height of said vertically disposed portion of a said first member being less than the vertical height of said body portion of a said second member held within the same snap-bar therewith.

2. A soffit for use in a metal ceiling panel suspended ceiling for concealing a beam depending from a floor slab which comprises:

a. first and second elongated snap-bars longitudinally extending along said beam on either side thereof, comprising spring-like arms extending from a common, integrally formed base portion and terminating in opposed free ends biased towards one another;

b. vertically disposed first and second elongated members held within said spring-like arms of each said snap-bar and depending from said snap-bars, said members in one snap-bar being opposed to the members in the other snap-bar and extending longitudinally along said beam on either side thereof;

c. each said first member having a vertically disposed portion held within said snap bar, a horizontally disposed portion terminating in a free end facing away from said beam, and retainer means at said free end for receiving and retaining a metal ceiling panel;

d. each said second member having a planar, vertically extending body portion with one horizontal edge thereof held within said snap-bar and with a clip portion longitudinally extending along and positioned above the opposite horizontal edge of said body portion, said clip portion having a spring-like arm integral with said body portion terminating in a free end biased toward said body portion, said clip portion facing toward said beam;

e. a metal ceiling panel below said beam and having a horizontally disposed planar bottom portion and a pair of opposed vertically disposed side walls snap-fitted into said clip portions, whereby said planar bottom portion of said panel is perpendicular to said body portions; and f. the vertical height of said vertically disposed portion of a said first member being less than the vertical height of said body portion of a said second member held within the same snap bar therewith.

3. The soffit according to claim 2, wherein a metal ceiling panel is secured to said second members below each said beam, said ceiling panel having opposed side walls retained in said clip portion of opposed second members.

4. The soffit according to claim 3, wherein said retainer means comprises u-shaped finger means into which an edge of the bottom of a metal ceiling panel is press-fit.

5. The soffit according to claim 2, including means for suspending said snap-bars from said floor slab.

* * * * *